US006460190B1

(12) United States Patent
Blum

(10) Patent No.: US 6,460,190 B1
(45) Date of Patent: Oct. 8, 2002

(54) CLEANING MITTEN

(76) Inventor: Daniel Blum, 1066 Sunbeam La., Corona, CA (US) 92881

( * ) Notice: Subject to any disclaimer, the term of this patent is extended or adjusted under 35 U.S.C. 154(b) by 0 days.

(21) Appl. No.: 09/871,798

(22) Filed: Jun. 1, 2001

(51) Int. Cl.[7] ..... A41D 25/00
(52) U.S. Cl. ..... 2/158; 2/160
(58) Field of Search ..... 2/158, 161.6, 161.8, 2/167, 160; 15/227

(56) References Cited

U.S. PATENT DOCUMENTS 2,657,391 A * 11/1953 Crandon ..... 2/161
3,151,333 A 10/1964 Scholz
4,748,711 A * 6/1988 Markus ..... 15/227
4,953,250 A * 9/1990 Brown ..... 15/104.94
5,867,829 A 2/1999 Hegoas et al. ..... 2/159
5,916,408 A 6/1999 Chen ..... 156/308.4

* cited by examiner

*Primary Examiner*—Rodney M. Lindsey
*Assistant Examiner*—James G Smith
(74) *Attorney, Agent, or Firm*—Goldstein & Lavas, P.C.

(57) ABSTRACT

A cleaning mitten including a mitten portion including a finger and palm section and a thumb section. The mitten further includes a front surface and a back surface. The mitten portion has an open lower end for receiving a hand therein. A sponge surface is disposed on the front surface and the back surface of the finger and palm section of the mitten portion. A nylon netting is disposed over the sponge surface. A rigid scraper extends outwardly of the thumb section of the mitten portion.

4 Claims, 1 Drawing Sheet

CLEANING MITTEN

BACKGROUND OF THE INVENTION

The present invention relates to a cleaning mitten and more particularly pertains to allowing kitchen items to be cleaned in an easy manner.

The use of cleaning devices is known in the prior art. More specifically, cleaning devices heretofore devised and utilized for the purpose of cleaning various objects are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,151,333 to Scholtz discloses a rubber glove with an abrasive surface. U.S. Pat. No. 5,916,408 to Chen discloses a method for producing a mitten-like scrubber comprised of a net assembly. U.S. Pat. No. 5,867,829 to Hegoas discloses a powder dispensing glove comprised of close-knit fabric and mesh.

While these devices fulfill their respective, particular objective and requirements, the aforementioned patents do not describe a cleaning mitten for allowing kitchen items to be cleaned in an easy manner.

In this respect, the cleaning mitten according to the present invention substantially departs from the conventional concepts and designs of the prior art, and in doing so provides an apparatus primarily developed for the purpose of allowing kitchen items to be cleaned in an easy manner.

Therefore, it can be appreciated that there exists a continuing need for a new and improved cleaning mitten which can be used for allowing kitchen items to be cleaned in an easy manner. In this regard, the present invention substantially fulfills this need.

SUMMARY OF THE INVENTION

In the view of the foregoing disadvantages inherent in the known types of cleaning devices now present in the prior art, the present invention provides an improved cleaning mitten. As such, the general purpose of the present invention, which will be described subsequently in greater detail, is to provide a new and improved cleaning mitten which has all the advantages of the prior art and none of the disadvantages.

To attain this, the present invention essentially comprises a mitten portion including a finger and palm section and a thumb section. The mitten further includes a front surface and a back surface. The mitten portion has an open lower end for receiving a hand therein. A sponge surface is disposed on the front surface and the back surface of the finger and palm section of the mitten portion. A nylon netting is disposed over the sponge surface. A rigid scraper extends outwardly of the thumb section of the mitten portion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved cleaning mitten which has all the advantages of the prior art cleaning devices and none of the disadvantages.

It is another object of the present invention to provide a new and improved cleaning mitten which may be easily and efficiently manufactured and marketed.

It is a further object of the present invention to provide a new and improved cleaning mitten which is of durable and reliable construction.

An even further object of the present invention is to provide a new and improved cleaning mitten which is susceptible of a low cost of manufacture with regard to both materials and labor, and which accordingly is then susceptible of low prices of sale to the consuming public, thereby making such a cleaning mitten economically available to the buying public.

Even still another object of the present invention is to provide a new and improved cleaning mitten for allowing kitchen items to be cleaned in an easy manner.

Lastly, it is an object of the present invention to provide a new and improved cleaning mitten including a mitten portion including a finger and palm section and a thumb section. The mitten further includes a front surface and a back surface. The mitten portion has an open lower end for receiving a hand therein. A sponge surface is disposed on the front surface and the back surface of the finger and palm section of the mitten portion. A nylon netting is disposed over the sponge surface. A rigid scraper extends outwardly of the thumb section of the mitten portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
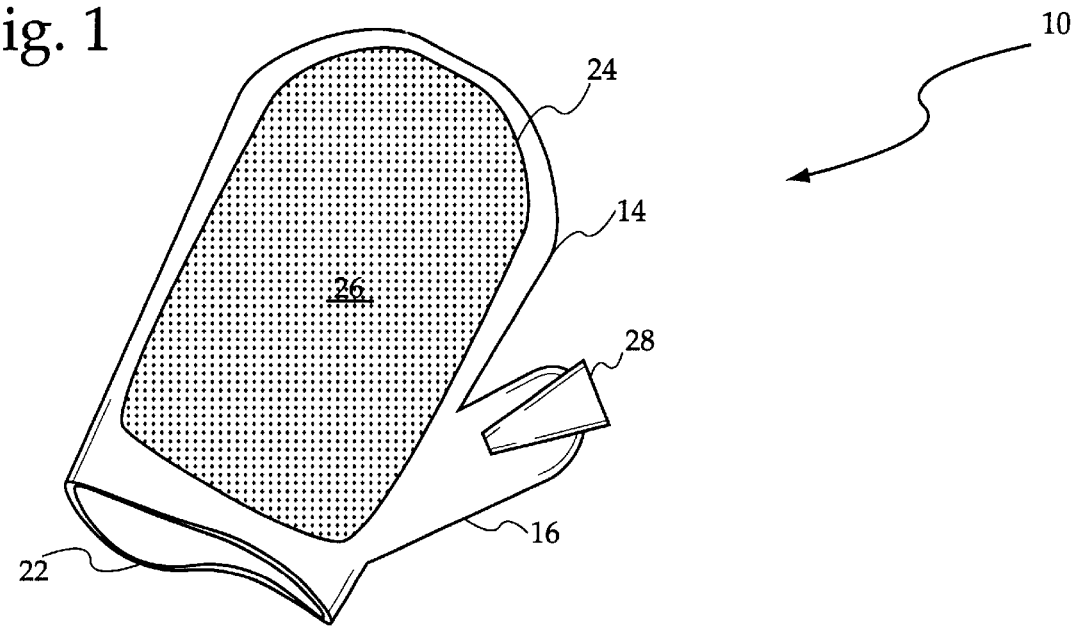
FIG. 1 is a perspective view of the preferred embodiment of the cleaning mitten constructed in accordance with the principles of the present invention.
Figure 2:
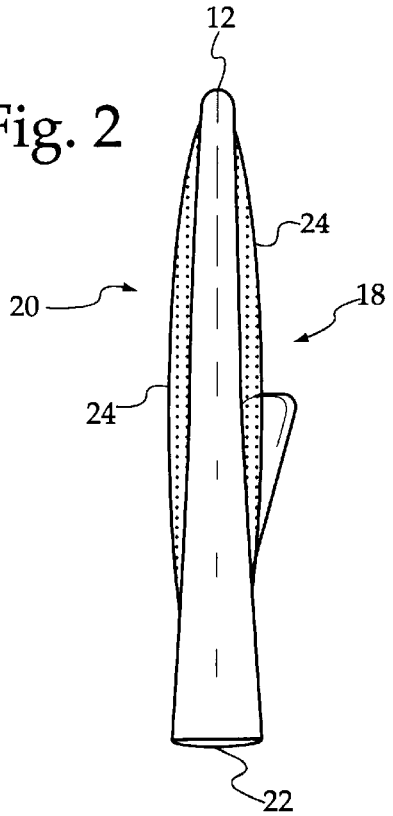
FIG. 2 is a side view of the present invention.
Figure 3:
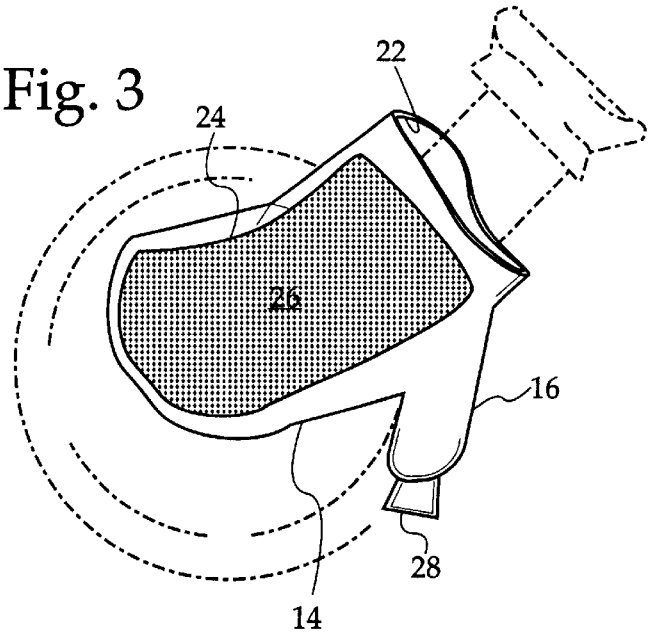
FIG. 3 is a plan view of the present invention illustrated in use.

With reference now to the drawings, and in particular, to FIGS. 1 through 3 thereof, the preferred embodiment of the new and improved cleaning mitten embodying the principles and concepts of the present invention and generally designated by the reference number 10 will be described.

Specifically, it will be noted in the various figures that the device relates to a cleaning mitten for allowing kitchen items to be cleaned in an easy manner. In its broadest context, the device consists of a mitten portion, a sponge surface, a nylon netting, and a rigid scraper. Such components are individually configured and correlated with respect to each other so as to attain the desired objective.

The mitten portion 12 includes a finger and palm section 14 and a thumb section 16. The mitten portion 12 could be constructed of a waterproof material to prevent contact of a user's hand with water and cleaning chemicals. The mitten portion 12 further includes a front surface 18 and a back surface 20. The mitten portion 12 has an open lower end 22 for receiving a hand therein. Additionally, the open lower end 22 could be provided with an elastic band to allow the mitten portion 12 to snugly engage a wrist of the user and prevent the passage of water interiorly of the mitten portion 12.

The sponge surface 24 is disposed on the front surface 18 and the back surface 20 of the finger and palm section 14 of the mitten portion 12. The sponge surface 24 can be removable from the mitten portion 12 to allow easy replacement once the sponge surface 24 becomes worn.

The nylon netting 26 is disposed over the sponge surface 24. The nylon netting 26 provides a more rigid surface than the sponge surface 24 to attack stubborn stains.

The rigid scraper 28 extends outwardly of the thumb section 16 of the mitten portion 12. The rigid scraper resembles ice scrapers, but is much smaller so as not to impede the use of the other components of the present invention, such as the sponge surface 24 and the nylon netting 26. The rigid scraper 28 will be used to clean objects that cannot be cleaned by the sponge surface 24 and the nylon netting 26.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cleaning mitten for allowing kitchen items to be cleaned in an easy manner comprising, in combination:

a mitten portion including a finger and palm section and a thumb section, the mitten further including a front surface and a back surface, the mitten portion having an open lower end for receiving a hand therein;

a sponge surface disposed on the front surface and the back surface of the finger and palm section of the mitten portion;

a nylon netting disposed over the sponge surface; and a rigid scraper extending outwardly of the thumb section of the mitten portion.

2. A cleaning mitten for allowing kitchen items to be cleaned in an easy manner comprising, in combination:

a mitten portion including a finger and palm section and a thumb section, the mitten further including a front surface and a back surface, the mitten portion having an open lower end for receiving a hand therein;

a sponge surface disposed on the front surface and the back surface of the finger and palm section of the mitten portions the cleaning mitten further including a nylon netting disposed over the sponge surface.

3. The cleaning mitten as set forth in claim 2, and further including a rigid scraper extending outwardly of the thumb section of the mitten portion.

4. The cleaning mitten as set forth in claim 1, wherein the sponge surface is removable with respect to the front and back surfaces of the mitten portion.

* * * * *